US008875626B2

(12) United States Patent
Morishita et al.

(10) Patent No.: US 8,875,626 B2
(45) Date of Patent: Nov. 4, 2014

(54) MACHINING OIL APPLYING APPARATUS

(75) Inventors: Keiichi Morishita, Tokyo (JP); Masaki Uehara, Tokyo (JP); Toshiyuki Nanaarashi, Tokyo (JP); Akio Ueda, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 392 days.

(21) Appl. No.: 12/908,525

(22) Filed: Oct. 20, 2010

(65) Prior Publication Data

US 2011/0088572 A1 Apr. 21, 2011

(30) Foreign Application Priority Data

Oct. 21, 2009 (JP) ..... 2009-241970

(51) Int. Cl.

| | |
|---|---|
| ***B30B 15/00*** | (2006.01) |
| ***B05C 1/06*** | (2006.01) |
| ***B05C 9/04*** | (2006.01) |

(52) U.S. Cl.

CPC .... *B05C 1/06* (2013.01); *B05C 9/04* (2013.01)

USPC ..... 100/75; 118/256

(58) Field of Classification Search

USPC ..... 100/73, 74, 75; 72/41, 43, 44, 45; 118/256; 427/429

See application file for complete search history.

(56) References Cited

U.S. PATENT DOCUMENTS

| | | | | |
|---|---|---|---|---|
| 3,863,599 | A * | 2/1975 | Kohn | 118/256 |
| 4,096,825 | A * | 6/1978 | Golias et al. | 118/221 |
| 5,417,181 | A * | 5/1995 | Idstein et al. | 118/231 |
| 2005/0223974 | A1 * | 10/2005 | Horie et al. | 118/227 |

FOREIGN PATENT DOCUMENTS

| | | | |
|---|---|---|---|
| CN | 2233288 | Y | 8/1996 |
| CN | 2239311 | Y | 11/1996 |
| CN | 2308457 | Y | 2/1999 |
| CN | 2688416 | Y | 3/2005 |
| CN | 1680044 | A | 10/2005 |
| CN | 1923399 | A | 3/2007 |
| EP | 1 584 377 | A2 | 10/2005 |
| JP | 6-70860 | U | 10/1994 |
| JP | 3022748 | U | 1/1996 |
| JP | 10-34273 | A | 2/1998 |
| KR | 1998-0041067 | U | 9/1998 |

* cited by examiner

*Primary Examiner* — Jimmy T Nguyen

(74) *Attorney, Agent, or Firm* — Birch, Stewart, Kolasch & Birch, LLP

(57) ABSTRACT

A machining oil applying apparatus that applies machining oil onto a thin metal plate that is being conveyed toward a press apparatus includes: an upper surface applying unit that is impregnated with machining oil, contacts an upper surface of the thin plate and applies the machining oil onto the upper surface; a lower surface applying unit that is impregnated with the machining oil, contacts an lower surface of the thin plate and applies the machining oil onto the lower surface; and an applying unit moving portion that causes the upper surface applying unit and the lower surface applying unit to move reciprocally in a direction perpendicular to a conveying direction of the thin plate, wherein the upper surface applying unit and the lower surface applying unit always move in respectively opposite directions perpendicular to the conveying direction.

4 Claims, 6 Drawing Sheets

MACHINING OIL APPLYING APPARATUS

CROSS-REFERENCE TO RELATED APPLICATIONS

This application is based upon and claims the benefit of priority of the prior Japanese Patent Application No. 2009-241970, filed on 21 Oct. 2009, the entire contents of which are incorporated herein by reference.

FIELD

The present invention relates to an apparatus for applying machining oil onto a machined material before machining.

BACKGROUND

In a manufacturing apparatus that manufactures heat exchanger fins for example, the machined material is a thin plate made of metal and heat exchanger fins are manufactured by machining such machined material using a press.

The thin metal plate is wound on an uncoiler, and thin metal plate that has been pulled from the uncoiler is supplied to a press apparatus equipped with a mold for manufacturing heat exchanger fins.

The thin plate supplied to the press apparatus is then subjected to press-machining to manufacture heat exchanger fins of a predetermined shape.

A machining oil applying apparatus is provided between the press apparatus and the uncoiler to apply machining oil onto the thin plate pulled from the uncoiler.

A typical method of applying machining oil onto the thin plate places a member, such as a roller, that has been impregnated with liquid machining oil in contact with the thin plate to apply the machining oil (see for example Patent Documents 1 and 2).

However, a method that does not use liquid machining oil but instead presses wax that is solid at room temperature onto the workpiece and applies the wax by moving the wax across the surface of the thin plate has also been disclosed (see for example Patent Document 3).

Patent Document 1

Japanese Utility Model Registration Number 3,022,748

Patent Document 2

Japanese Utility Model Publication H06-70860

Patent Document 3

Japanese Laid-Open Patent Publication No. H10-34273

SUMMARY

Recently, worldwide attention on environmental problems and fluctuations in economic conditions have made it necessary to economize on machining oil.

However, with the conventional method where machining oil is applied by placing a member that is impregnated with a liquid machining oil in contact with the thin plate, if the amount of machining oil used to impregnate the member were reduced to economize on the machining oil, there would be the risk that the machining oil would be unevenly distributed within the member impregnated with the machining oil, which would result in machining oil being applied to only some parts of the thin plate (see FIG. 8).

Patent Document 3 mentioned above discloses a technology for moving wax across the surface of a thin plate. By adopting the construction disclosed in Patent Document 1, it is possible to conceive a device capable of spreading machining oil across the surface of the thin plate even when the machining oil is unevenly distributed in the member that has been impregnated with the machining oil.

However, when the thickness of the thin metal plate is made extremely thin (0.3 mm or below for example), there is the problem that when a member that has been impregnated with machining oil is placed in contact with the surface of the thin plate and moved across the surface, the thin plate will become crinkled in the direction in which the member is moved, which prevents the thin plate from being conveyed to the press apparatus.

The present invention was conceived to solve the problem described above and it is an object of the present invention to provide a machining oil applying apparatus that is capable of placing a member that has been impregnated with a reduced amount of machining oil in contact with a thin plate and moving the member while preventing the thin plate from becoming crinkled.

To achieve the above object, the present invention has the following construction. That is, a machining oil applying apparatus according to the present invention applies machining oil onto a thin plate made of metal that is to be supplied to a press apparatus and is being conveyed toward the press apparatus, the machining oil applying apparatus including: an upper surface applying unit that is impregnated with the machining oil, contacts an upper surface of the thin plate and applies the machining oil onto the upper surface of the thin plate; a lower surface applying unit that is impregnated with the machining oil, contacts a lower surface of the thin plate and applies the machining oil onto the lower surface of the thin plate; and an applying unit moving portion that causes the upper surface applying unit and the lower surface applying unit to move reciprocally in a direction that is perpendicular to a conveying direction of the thin plate, wherein the applying unit moving portion causes the upper surface applying unit and the lower surface applying unit to always move in respectively opposite directions in the direction that is perpendicular to the conveying direction of the thin plate.

By using the above construction, the upper surface applying unit and the lower surface applying unit move with opposite phase in the width direction that is perpendicular to the conveying direction of the thin plate. That is, the forces applied to the thin plate by the upper surface applying unit and the lower surface applying unit always cancel out on both (i.e., upper and lower) surfaces of the thin plate, which makes it possible to avoid bending the thin plate.

The machining oil applying apparatus may further include an upper surface machining oil spreading portion that contacts the upper surface of the thin plate to make a pattern of the machining oil applied by the upper surface applying unit uniform, the upper surface machining oil spreading portion being provided downstream in the conveying direction of the thin plate of a position where the upper surface applying unit is disposed, and a lower surface machining oil spreading portion that contacts the lower surface of the thin plate to make a pattern of the machining oil applied by the lower surface applying unit uniform, the lower surface machining oil spreading portion being provided downstream in the conveying direction of the thin plate of a position where the lower surface applying unit is disposed.

By using the above construction, even when parts where oil cannot be applied are produced across the entire surface of the thin plate in spite of the upper surface applying unit and the lower surface applying unit moving, it is possible for the upper surface machining oil spreading portion and the lower surface machining oil spreading portion to spread and apply the machining oil applied on other parts onto the parts where oil could not be applied.

In addition, the upper surface applying unit and/or the lower surface applying unit may be constructed so that an impregnated member that is impregnated with the machining oil is divided into a plurality of members in a direction that is perpendicular to the conveying direction of the thin plate, and partitions that prevent the machining oil from passing may be provided between the respective members produced by dividing the impregnated member.

That is, when the impregnated member is formed of a single body in the width direction of the thin plate (i.e., "a direction that is perpendicular to the conveying direction"), there has been the problem that when the impregnated amount of machining oil is reduced, the machining oil tends to move in the width direction, making the impregnated member susceptible to uneven impregnation. However, according to the above construction, there is no movement of the machining oil along the entire length in the width direction, which makes the construction resistant to uneven impregnation.

In addition, when the machining oil is applied by placing an impregnated member in contact with the thin plate, since pressure tends to act upon both ends of the impregnated member in the width direction of the thin plate, abrasion of the impregnated member is severe at both ends compared to other positions. In such case, it is wasteful to replace the entire impregnated member because of abrasion only at both ends. However, with the construction described above, it is possible to replace only the impregnated members at positions where abrasion has occurred, which results in superior cost performance.

Also, the upper surface applying unit described above may include: an impregnated member that is impregnated with the machining oil; a holding member that holds circumferential side surfaces of the impregnated member; and a pressure applying unit for applying pressure to an opposite surface of the impregnated member to a contact surface of the impregnated member that contacts the thin plate so as to uniformly press the contact surface onto the thin plate.

According to the above construction, the impregnated member contacts the thin plate with a uniform force, which makes it possible to uniformly apply the machining oil and to prevent partial abrasion of the impregnated member.

Note that the pressure applying unit may include: a pressure applying pin that applies pressure to the opposite surface of the impregnated member to the contact surface; an air accumulating chamber in which an upper end surface of the pressure applying pin is disposed; an air supplying unit for supplying air into the air accumulating chamber; and a plate that covers the opposite surface of the impregnated member to the contact surface and is capable of movement in an up-down direction, wherein the pressure applying pin may apply pressure to the plate due to air supplied into the air accumulating chamber.

According to the above construction, the impregnated member is caused to contact the thin plate with a uniform force using a simple means, which makes it possible to uniformly apply the machining oil and to prevent partial abrasion of the impregnated member.

Note that the machining oil applying apparatus may further include thin plate support portions that contact both side surfaces formed in a direction that is perpendicular to the conveying direction of the thin plate.

According to the above construction, it is possible to convey the thin plate to a press apparatus more reliably.

In addition, the lower surface applying unit may include impregnated member bearing rollers that are freely rotatable with the conveying direction of the thin plate as axes thereof and are operable when the upper surface applying unit has moved and an impregnated member of the upper surface applying unit has become exposed from a direction perpendicular to the conveying direction of the thin plate at a position where the thin plate is not present, to contact a lower surface of the exposed impregnated member.

According to the above construction, even if the impregnated member of the upper surface applying unit protrudes outward from the thin plate in the width direction of the thin plate (a direction perpendicular to the conveying direction) due to the movement of the upper surface applying unit, it is possible to support the protruding impregnated member using the impregnated member bearing rollers so as to prevent the impregnated member from falling out or the like.

With the machining oil applying apparatus according to the present invention, it is possible to reliably apply machining oil onto a thin plate even when economizing on machining oil and to reliably convey the thin plate to a press apparatus without bending the thin plate.

DESCRIPTION OF EMBODIMENT(S)

Preferred embodiments of the invention will now be described in detail with reference to the drawings.

Figure 1:
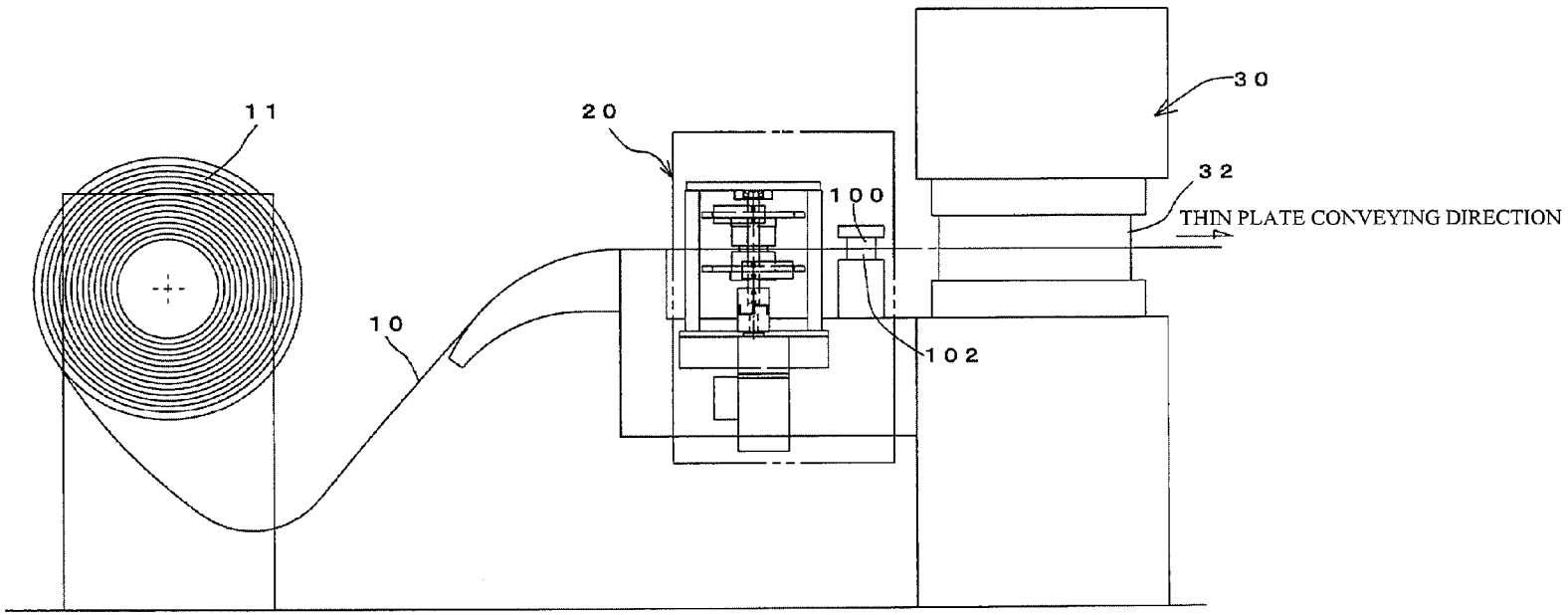
FIG. 1 is a diagram useful in explaining the layout and construction of a heat exchanger fin manufacturing apparatus.

FIG. 1 depicts the layout and construction of a heat exchanger fin manufacturing apparatus that uses a thin plate made of metal and manufactures heat exchanger fins by machining the thin plate using a press.

The heat exchanger fins are molded from a thin metal plate 10 made of aluminum or the like. The thin metal plate 10 is disposed by being wound onto an uncoiler 11. The thin plate 10 pulled out from the uncoiler 11 is supplied to the machining oil applying apparatus 20 according to the present invention and to a press apparatus 30 disposed downstream of the machining oil applying apparatus 20.

The press apparatus 30 includes a mold 32 for molding into a desired fin shape.

The machining oil applying apparatus 20 is disposed before the press apparatus 30 in the conveying direction of the thin plate 10 and functions so as to apply machining oil onto the thin metal plate 10 before the thin metal plate 10 is supplied to the press apparatus 30.

Note that the pulling out and conveying of the thin plate 10 from the uncoiler 11 are carried out by having a conveying apparatus (not depicted) in the press apparatus 30 pull the thin plate 10 in the conveying direction.

Figure 2:
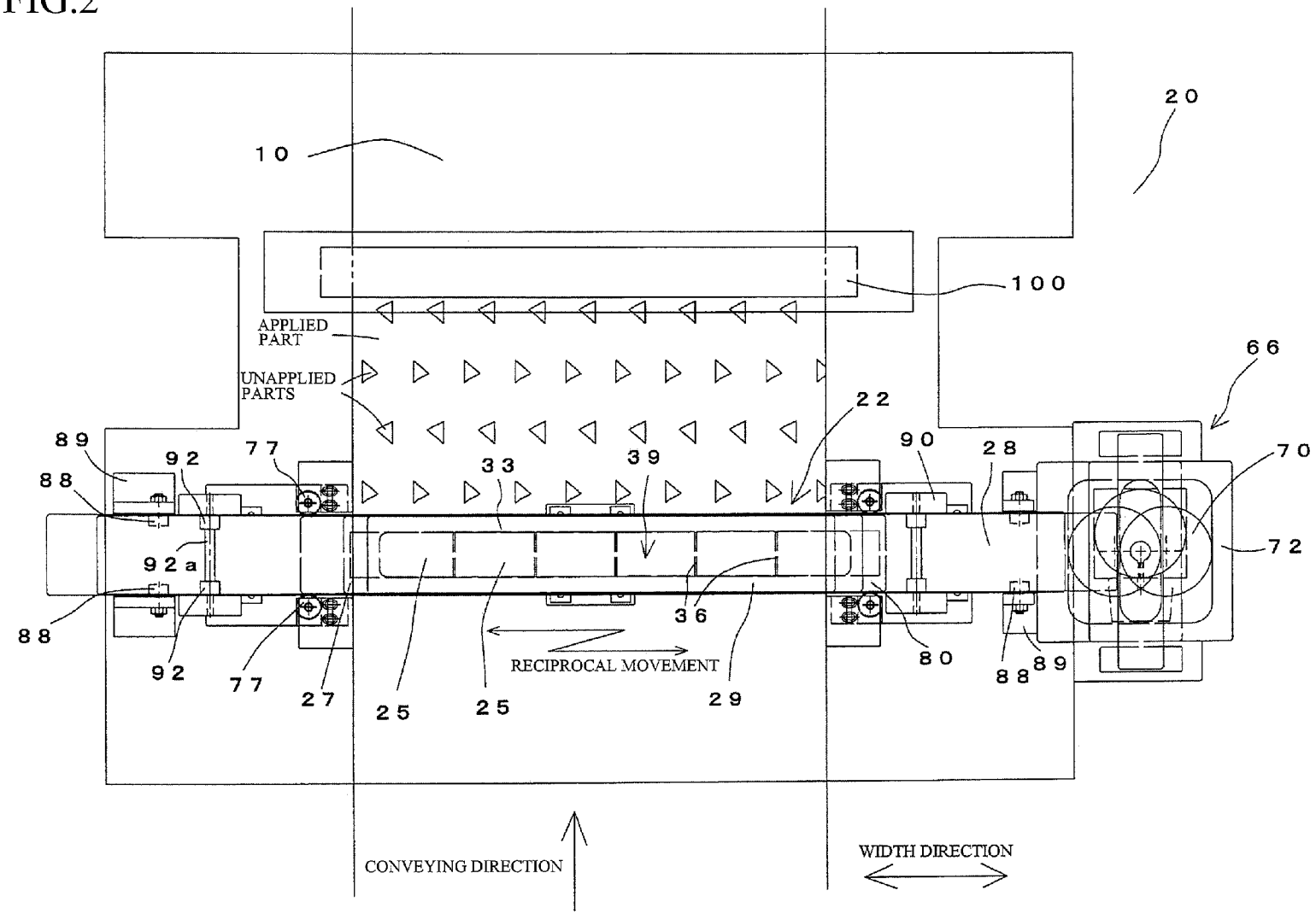
FIG. 2 is a plan view of a machining oil applying apparatus.
Figure 3:
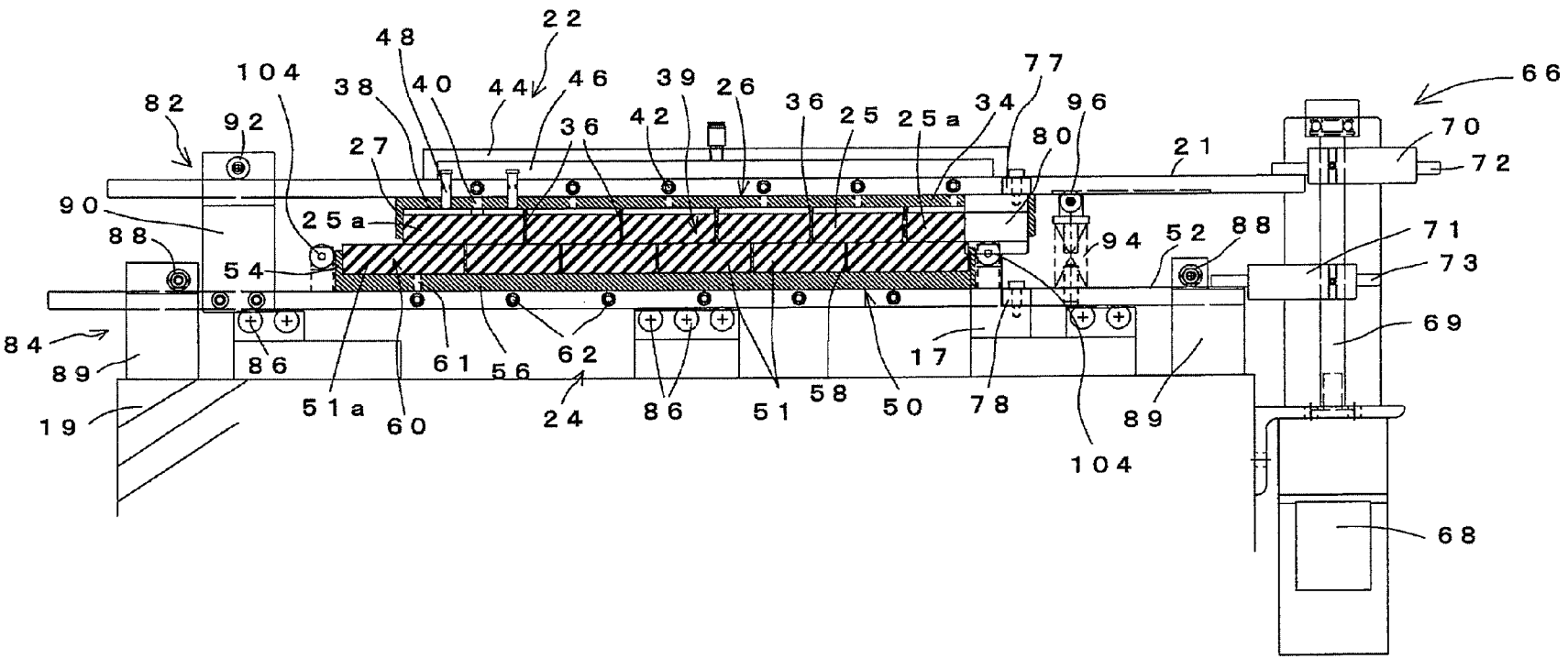
FIG. 3 is a side view of the machining oil applying apparatus.

FIG. 2 is a plan view of the machining oil applying apparatus 20 and FIG. 3 is a front view of the machining oil applying apparatus 20 (when looking in the conveying direction).

The machining oil applying apparatus 20 includes an upper surface applying unit 22 that makes contact with an upper surface of the thin plate 10 and applies machining oil onto the upper surface of the thin plate 10 and a lower surface applying unit 24 that makes contact with a lower surface of the thin plate 10 and applies machining oil onto the lower surface of the thin plate 10.

In the upper surface applying unit 22, a plurality of impregnated members 25 that have been impregnated with machining oil are disposed in the width direction of the thin plate 10 (a direction that is perpendicular to the conveying direction). As the impregnated members 25, it is possible to use any material that is capable of being impregnated with machining oil and has sufficient durability when placed in contact with the surface of the thin plate 10. In the present embodiment, felt, which is one type of nonwoven fabric, is used.

In the lower surface applying unit 24 also, a plurality of the same impregnated members 25 as the upper surface applying unit 22 are disposed in the width direction of the thin metal plate 10 (i.e., a direction that is perpendicular to the conveying direction).

Upper Surface Applying Unit

The upper surface applying unit 22 includes a holder portion 26 that holds the impregnated members 25. An upper plate 21 that is formed so as to be longer than the width of the thin plate 10 is attached to the upper part of the holder portion 26. The upper plate 21 is provided so as to move together with the holder portion 26 so as to reciprocally move the impregnated members 25 in the width direction of the thin plate 10.

Holder Portion

The holder portion 26 includes side surface holding walls 27, 27 that hold both side surfaces in the width direction of the impregnated members 25*a*, 25*a* that are present at both ends in the width direction (the width direction of the thin plate) of the plurality of impregnated members 25, a front surface holding wall 29 that holds front surfaces (the upstream side in the conveying direction of the thin plate) of the plurality of impregnated members 25, and a rear surface holding wall 33 that holds rear surfaces (the downstream side in the conveying direction of the thin plate) of the plurality of impregnated members 25.

An upper surface wall 34 is provided above the side surface holding walls 27, 27, the front surface holding wall 29, and the rear surface holding wall 33 and is disposed so as to cover upper surfaces of the plurality of impregnated members 25. The upper surface wall 34 is fixed to the upper plate 21.

A plurality of partition walls 36 are provided so as to extend downward from the upper surface wall 34. The partition walls 36 are disposed between members out of the plurality of impregnated members 25 and function so as to prevent machining oil from passing between the impregnated members 25.

The side surface holding walls 27, 27, the front surface holding wall 29, the rear surface holding wall 33, and the plurality of partition walls 36 are formed with suitable lengths so that lower ends thereof do not protrude beyond lower surfaces of the impregnated members 25, which enables the lower surfaces of the impregnated members 25 to contact the upper surface of the thin plate 10 without being obstructed by the respective walls.

In this way, the respective impregnated members 25 are enclosed and held inside separate enclosure portions 39 that are open to below and are surrounded by the upper surface wall 34, the front surface holding wall 29, the rear surface holding wall 33, and the partition walls 36 (and, in the case of the impregnated members 25 disposed at both ends in the width direction of the thin plate 10, also the side surface holding walls 27).

To prevent the impregnated members 25 from falling out of the enclosure portions 39, the side surface holding walls 27, the front surface holding wall 29, the rear surface holding wall 33, and the plurality of partition walls 36 are disposed at an angle so as to approach one another toward the bottom, resulting in the openings at the bottoms of the enclosure portions 39 becoming somewhat narrower. The side surface holding walls 27, the front surface holding wall 29, and the rear surface holding wall 33 correspond to the "holding member" mentioned in the patent claims.

Oil supplying channels 40 that supply the machining oil and are formed so as to pass through the upper surface wall 34 are provided in the respective enclosure portions 39. The oil supplying channels 40 are connected to oil supplying openings 42 formed on the side surface of the upper plate 21 and the machining oil supplied from the oil supplying openings 42 is supplied via the oil supplying channels 40 to the respective enclosure portions 39.

Note that a pressure-applying means for applying downward pressure to the impregnated members 25 is provided above the upper plate 21. The pressure applying means includes an air accumulating chamber 46 formed by a cover 44 disposed above the upper plate 21, pressure-applying pins 48 that are capable of moving in the air accumulating chamber 46 and the enclosure portions 39 in the up-down direction, and a plate 38 that is disposed so as to be capable of moving in the up-down direction between the upper surface wall 34 of the holder portion 26 and the upper surfaces of the impregnated members 25. The plate 38 is large enough to cover the entire upper surfaces of all of the impregnated members 25. The pressure-applying pins 48 are disposed so as to pass through the upper surface wall 34 of the holder portion 26 and the upper plate 21 and are provided so that upper end portions thereof are positioned inside the air accumulating chamber 46. Although only some of the pressure-applying pins 48 are depicted in FIG. 3, a pressure-applying pin 48 is actually provided in every enclosure portion 39.

Air is supplied into the air accumulating chamber 46 by an air supplying means (not depicted). It is possible to use an air compressor or the like as the air supplying means. When air is supplied into the air accumulating chamber 46, the upper end portions of the pressure-applying pins 48 are pressed downward by the air so that lower end portions of the pressure-applying pins 48 apply pressure onto the upper surface of the plate 38. By doing so, it is possible for the impregnated members 25 to always contact the thin plate 10 with a constant force.

Since one air accumulating chamber 46 is formed for the plurality of impregnated members 25, the same force is applied to all of the impregnated members 25.

Lower Surface Applying Unit

The lower surface applying unit 24 includes a holder portion 50 that holds the impregnated members 51. A lower plate 52 that is formed so as to be longer than the width of the thin plate 10 is attached to the lower part of the holder portion 50. The lower plate 52 is provided so as to be capable of moving the holder portion 50 so as to reciprocally move the impregnated members 51 in the width direction of the thin plate 10.

Holder Portion

The holder portion 50 includes side surface holding walls 54, 54 that hold both side surfaces in the width direction of the impregnated members 51*a*, 51*a* that are present at both ends in the width direction (the width direction of the thin plate) of the plurality of impregnated members 51, a front surface holding wall (not depicted) that holds front surfaces (the upstream side in the conveying direction of the thin plate) of the plurality of impregnated members 51, and a rear surface holding wall (not depicted) that holds rear surfaces (the downstream side in the conveying direction of the thin plate) of the plurality of impregnated members 51.

A lower surface wall 56 is provided below the side surface holding walls 54, 54, the front surface holding wall, and the rear surface holding wall and is disposed so as to cover lower surfaces of the plurality of impregnated members 51. The lower surface wall 56 is fixed to the lower plate 52.

A plurality of partition walls 58 are provided so as to extend upward from the lower surface wall 56. The partition walls 58 are disposed between members out of the plurality of impregnated members 51 and function so as to prevent machining oil from passing between the impregnated members 51.

The side surface holding walls 54, 54, the front surface holding wall, the rear surface holding wall, and the plurality of partition walls 58 are formed with suitable lengths so that upper end portions thereof do not protrude beyond upper surfaces of the impregnated members 51, which enables the upper surfaces of the impregnated members 51 to contact the lower surface of the thin plate 10 without being obstructed by the respective walls.

In this way, the respective impregnated members 51 are enclosed and held inside separate enclosure portions 60 that are open to above and are surrounded by the lower surface wall 56, the front surface holding wall, the rear surface holding wall, and the partition walls 58 (and, in the case of the impregnated members disposed at both ends in the width direction of the thin plate 10, also the side surface holding walls 54).

Oil supplying channels 61 that supply the machining oil and are formed so as to pass through the lower surface wall 56 are provided in the respective enclosure portions 60. The oil supplying channels 61 are connected to oil supplying openings 62 formed on the side surface of the lower plate 52 and the machining oil supplied from the oil supplying openings 62 is supplied via the oil supplying channels 61 to the respective enclosure portions 60.

Applying Unit Moving Portion

Although the upper surface applying unit 22 and the lower surface applying unit 24 described above are capable of being reciprocally moved in the width direction of the thin plate 10 by an applying unit moving portion 66, the applying unit moving portion 66 causes the upper surface applying unit 22 and the lower surface applying unit 24 to always move in respectively opposite directions in the width direction of the thin plate 10. Putting this another way, the applying unit moving portion 66 causes the upper surface applying unit 22 and the lower surface applying unit 24 to move reciprocally in the width direction of the thin plate 10 with opposite phase.

Figure 4:
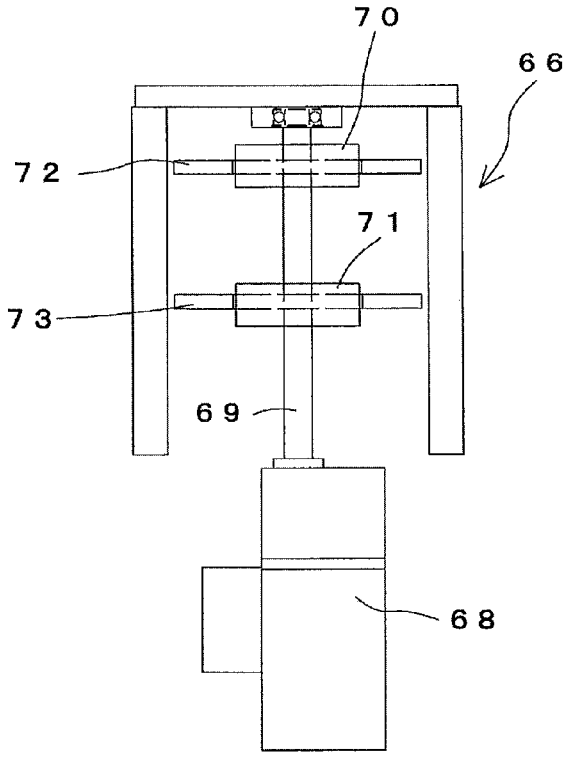
FIG. 4 is a side view of an applying unit moving portion.
Figure 5:
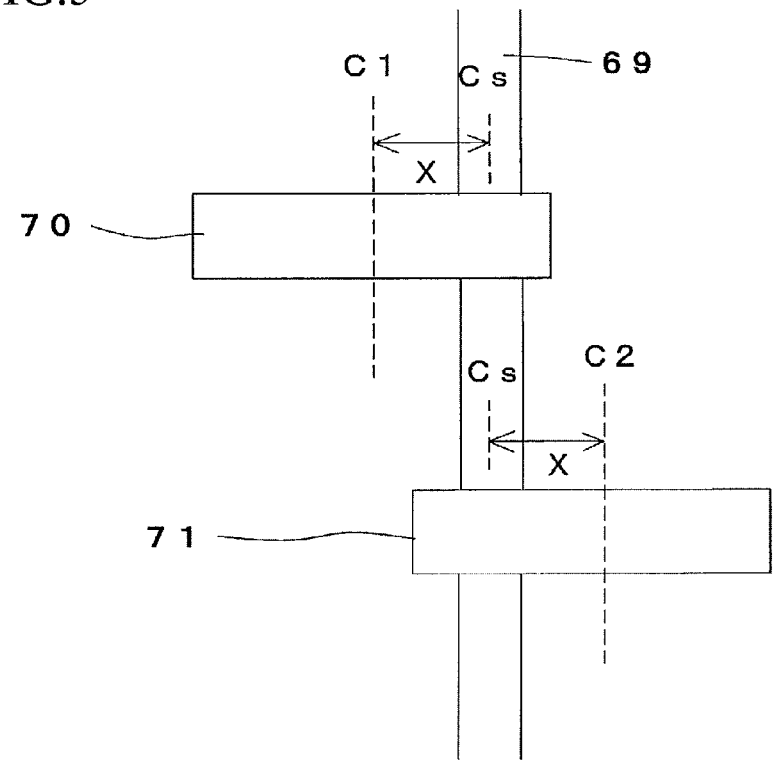
FIG. 5 is an enlarged view of an applying unit moving portion.
Figure 6:
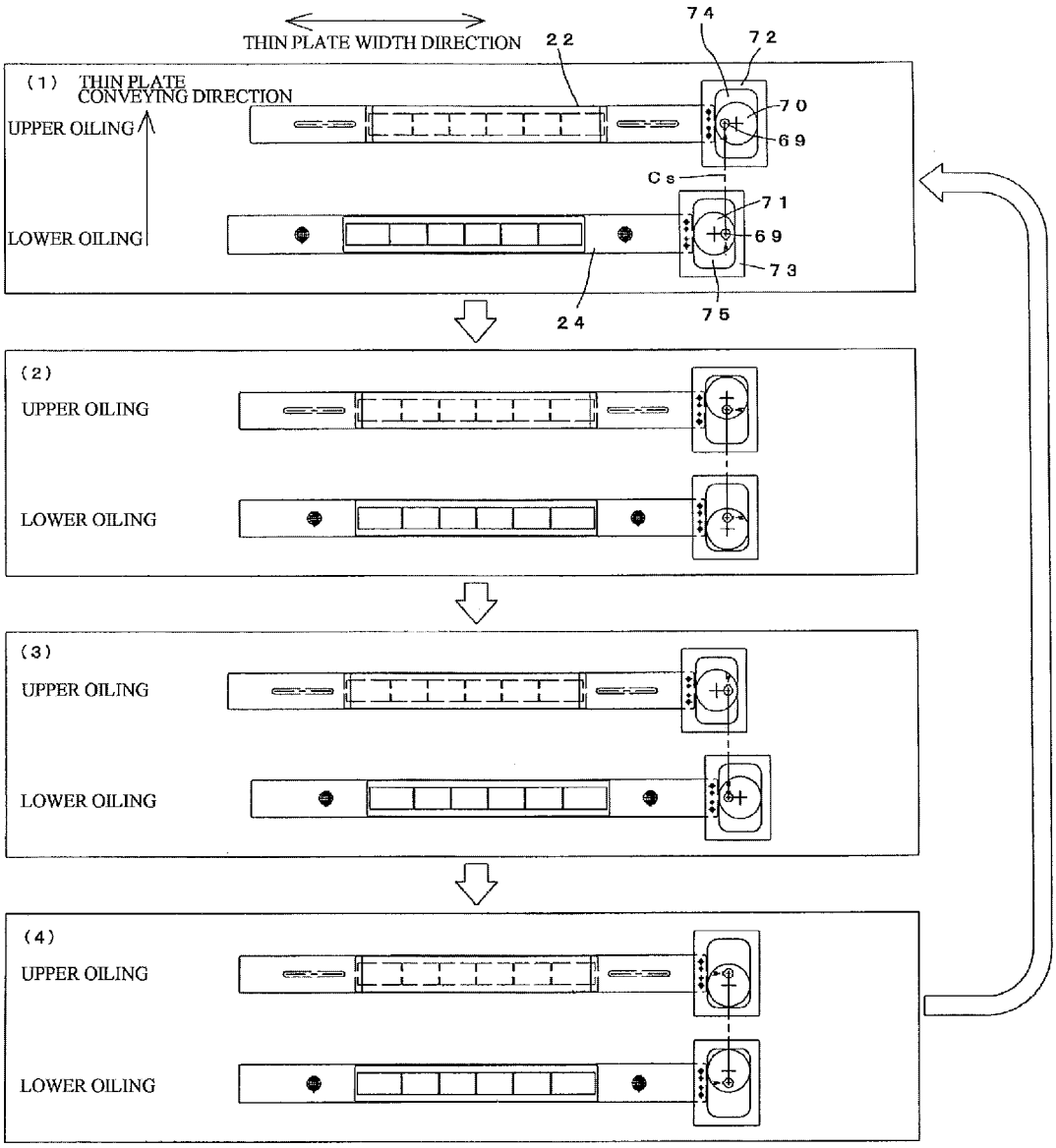
FIG. 6 is a diagram useful in explaining an operating state of an upper surface applying unit and a lower surface applying unit.

FIG. 4 is a side view of the applying unit moving portion 66, FIG. 5 is a diagram depicting how eccentric cams are attached inside the applying unit moving portion 66, and FIG. 6 is a diagram useful in explaining the operation of the applying unit moving portion 66.

The applying unit moving portion 66 includes a motor 68 whose rotational shaft 69 is disposed so as to extend in the vertical direction and two eccentric cams 70, 71 that are attached onto the rotational shaft 69 of the motor 68. Cam guide plates 72, 73 are respectively provided around the eccentric cams 70, 71.

The upper eccentric cam 70 and the lower eccentric cam 71 are plate-shaped members that are both circular when viewed from above.

The rotational shaft 69 passes through and is fixed to the upper eccentric cam 70 at a position that is a predetermined distance X from a center C1 of the circle. This means that due to the rotation of the rotational shaft 69, the upper eccentric cam 70 rotates eccentrically about the axis Cs of the rotational shaft 69.

The rotational shaft 69 passes through and is fixed to the lower eccentric cam 71 at a position that is a predetermined distance X from a center C2 of the circle, the position also being set so that the center C1 of the circle of the upper eccentric cam 70 and the center C2 of the circle of the lower eccentric cam 71 exhibit point symmetry about the axis Cs of the rotational shaft 69. This means that due to the rotation of the rotational shaft 69, the lower eccentric cam 71 rotates eccentrically about the axis Cs of the rotational shaft 69.

The upper cam guide plate 72 disposed around the upper eccentric cam 70 positioned at the top is substantially rectangular when viewed from above and has a rectangular cam hole 74 in which the upper eccentric cam 70 is enclosed formed in the center thereof. The length in the shorter-edge direction of the cam hole 74 (the same direction as the width direction of the thin plate 10) is formed so that the outer circumferential edge of the upper eccentric cam 70 is just wide enough to contact the inner wall surface of the cam hole 74. The upper eccentric cam 70 is capable of moving in the longer-edge direction (the same direction as the conveying direction of the thin plate 10) inside the cam hole 74.

The upper plate 21 is fixed to one end in the width direction of the upper cam guide plate 72.

On the other hand, the lower cam guide plate 73 disposed around the lower eccentric cam 71 positioned below the upper eccentric cam 70 is substantially rectangular when viewed from above and has a rectangular cam hole 75 in which the lower eccentric cam 71 is enclosed formed in the center thereof. The length in the shorter-edge direction of the cam hole 75 (the same direction as the width direction of the thin plate 10) is formed so that the outer circumferential edge of the lower eccentric cam 71 is just wide enough to contact the inner wall surface of the cam hole 75. The lower eccentric cam 71 is capable of moving in the longer-edge direction (the same direction as the conveying direction of the thin plate 10) inside the cam hole 75.

The lower plate 52 is fixed to one end in the width direction of the lower cam guide plate 73.

Movement of the upper surface applying unit 22 and the lower surface applying unit 24 by the applying unit moving portion 66 will now be described.

When the motor 68 is driven, the rotational shaft 69 rotates with the vertical direction as the axis thereof. Since the center positions of the respective circles of the upper eccentric cam 70 and the lower eccentric cam 71 fixed to the rotational shaft 69 are positioned with point symmetry with respect to the rotational shaft 69, the movement of the upper cam guide plate 72 and the lower cam guide plate 73 in the horizontal direction will always be in opposite directions.

An example operation will now be described with reference to FIG. 6.

As depicted in state (1) in FIG. 6, when the center C1 of the upper eccentric cam 70 is positioned furthest from the thin plate 10, the upper cam guide plate 72 will have moved due to rotation of the upper eccentric cam 70 to a closest position to the applying unit moving portion 66 (to the right when looking from the conveying direction of the thin plate 10), and the upper surface applying unit 22 will have moved above the thin plate 10 to a position that is closest to the applying unit moving portion 66 (to the right when looking from the conveying direction).

In state (1), the center C2 of the lower eccentric cam 71 is positioned closest to the thin plate 10, the lower cam guide plate 73 will have moved due to rotation of the lower eccentric cam 71 to a furthest position from the applying unit moving portion 66 (to the left when looking from the conveying direction of the thin plate 10), and the lower surface applying unit 24 will have moved above the thin plate 10 to a position that is furthest from the applying unit moving portion 66 (to the left when looking from the conveying direction).

When the upper eccentric cam 70 rotates inside the cam hole 74 of the upper cam guide plate 72 from state (1), the upper eccentric cam 70 will press the upper cam guide plate 72 in a direction away from the applying unit moving portion 66 (to the left when looking from the conveying direction of the thin plate 10) as depicted in state (2).

In the same way, when the lower eccentric cam 71 rotates inside the cam hole 75 of the lower cam guide plate 73 from state (1), the lower eccentric cam 71 will pull the lower cam guide plate 73 in a direction toward the applying unit moving portion 66 (to the right when looking from the conveying direction of the thin plate 10) as depicted in state (2).

State (2) illustrates a point where the upper surface applying unit 22 and the lower surface applying unit 24 have moved to substantially the same position when looking from above.

When the upper eccentric cam 70 further rotates inside the cam hole 74 of the upper cam guide plate 72 from state (2), the upper eccentric cam 70 will press the upper cam guide plate 72 in a direction away from the applying unit moving portion 66 (to the left when looking from the conveying direction of the thin plate 10) as depicted in state (3).

When the lower eccentric cam 71 further rotates inside the cam hole 75 of the lower cam guide plate 73 from state (2), the lower eccentric cam 71 will pull the lower cam guide plate 73 in a direction toward the applying unit moving portion 66 (to the right when looking from the conveying direction of the thin plate 10) as depicted in state (3).

When the upper eccentric cam 70 rotates inside the cam hole 74 of the upper cam guide plate 72 from state (3), the upper eccentric cam 70 will pull the upper cam guide plate 72 in a direction toward the applying unit moving portion 66 (to the right when looking from the conveying direction of the thin plate 10) as depicted in state (4).

In the same way, when the lower eccentric cam 71 rotates inside the cam hole 75 of the lower cam guide plate 73 from state (3), the lower eccentric cam 71 will press the lower cam guide plate 73 in a direction away from the applying unit moving portion 66 (to the left when looking from the conveying direction of the thin plate 10) as depicted in state (4).

State (4) illustrates a point where the upper surface applying unit 22 and the lower surface applying unit 24 have moved to substantially the same position when looking from above.

Since the applying unit moving portion 66 with the construction described above causes the upper surface applying unit 22 and the lower surface applying unit 24 to move reciprocally with opposite phase in the width direction of the thin plate 10, it is possible for forces to always act toward both sides in the width direction of the thin plate 10 and thereby prevent the thin plate 10 from bending.

Guide Mechanism of the Upper and Lower Plates

Note that although the applying unit moving portion 66 described above reciprocally moves the upper surface applying unit 22 and the lower surface applying unit 24 in the width direction of the thin plate 10 according to the rotation of the eccentric cams, forces that cause reciprocal movement in the conveying direction of the thin plate 10 will also act due to the rotation of the eccentric cams.

For this reason, upper plate guide rollers 77, which hold both side surfaces of the upper plate 21 of the upper surface applying unit 22 in the conveying direction of the thin plate, and lower plate guide rollers 78, which hold both side surfaces of the lower plate 52 of the lower surface applying unit 24 in the conveying direction of the thin plate, are provided.

Two lower plate guide rollers 78 are provided in a pair on a mount portion 17 on a base 19 so as to be capable of freely rotating in the horizontal plane, and are disposed at positions that contact both side surfaces of the lower plate 52 in the conveying direction of the thin plate.

A pair of block-shaped thin-plate guides 80 that contact side surfaces in the width direction of the thin plate 10 and prevent movement of the thin plate 10 in the width direction are also provided on the mount portion 17. Two thin-plate guides 80 are provided in a pair so that movement of the upper plate 21 is not obstructed, and the respective guides are positioned on the sides of the upper plate 21 in the conveying direction of the thin plate 10.

By doing so, even if the upper surface applying unit 22 and the lower surface applying unit 24 move reciprocally on both surfaces of the thin plate 10, end portions of the thin plate 10 in the width direction are held by the thin-plate guides 80, which makes it possible to prevent movement of the thin plate 10 in the width direction.

The upper plate guide rollers 77 that are capable of rotating freely in the horizontal plane are provided on upper surfaces of the thin-plate guides 80 so as to be disposed at positions that contact both side surfaces of the upper plate 21 in the conveying direction of the thin plate.

Although the lower plate guide rollers 78, the thin-plate guides, and the upper plate guide rollers 77 are only depicted on the applying unit moving portion 66 side in FIG. 3 (i.e., the right side in the drawing), the lower plate guide rollers 78, the thin-plate guides 80, and the upper plate guide rollers 77 are also provided with the same construction as described above on the opposite side to the side where the applying unit moving portion 66 is provided.

Upper/Lower Plate Pressing Mechanism

In order for the upper surface applying unit 22 and the lower surface applying unit 24 to reliably apply the machining oil onto the upper surface and the lower surface of the thin plate 10, an upper plate pressing portion 82 that sets the position of the upper plate 21 in the up-down direction and a lower plate pressing portion 84 that sets the position of the lower plate 52 in the up-down direction are provided.

The lower plate pressing portion 84 includes a plurality of holding rollers 86, which are disposed on the base 19, contact the lower surface of the lower plate 52, and are capable of freely rotating with the conveying direction of the thin plate as axes thereof, and pressing rollers 88 which contact the upper surface of the lower plate 52 and are capable of freely rotating with the conveying direction of the thin plate as axes thereof. The pressing rollers 88 form a pair with one pressing roller 88 provided on each of two support blocks 89 that are disposed so as to protrude upward from the base 19 on both sides of the lower plate 52 in the conveying direction of the thin plate.

Note that the holding rollers 86 are provided at three positions along the width direction of the thin plate.

The upper plate pressing portion 82 includes two fixed plates 90 that are fixed to both side surfaces of the lower plate 52 in the conveying direction of the thin plate and two pressing rollers 92 that are provided on the two fixed plates 90, contact the upper surface of the upper plate 21, and are capable of freely rotating with the conveying direction of the thin plate as axes thereof. The pressing rollers 92 are linked to one another by a linking member 92*a*.

The upper plate pressing portion 82 is also provided with an energizing means 94 that energizes the upper plate pressing portion 82 upward from the lower plate 52 and holding rollers 96 that are provided on the upper end of the energizing means 94 and are capable of freely rotating with the conveying direction of the thin plate as axes thereof. The holding rollers 96 are energized upward by the energizing means 94 and act so as to press the lower surface of the upper plate 21 upward.

Note that although the upper plate pressing portion 82 is depicted in FIG. 3 with the pressing roller 92 on the left in FIG. 3 and the holding roller 96 on the right, in reality a pressing roller 92 is also provided on the right in the drawing and a holding roller 96 is also provided on the left so that the pressing rollers 92 and the holding rollers 96 are provided in pairs.

In this way, since the upper plate pressing portion 82 is fixed to the lower plate 52, the gap between the lower plate 52 and the upper plate 21 does not change.

This means that it is possible for the upper surface applying unit 22 and the lower surface applying unit 24 to apply a stable amount of machining oil onto the thin plate 10.

Impregnated Member Bearing Rollers

The lower surface applying unit 24 is provided with impregnated member bearing rollers 104 that are provided outside the two side surface holding walls 54 of the enclosure portions 60 in the width direction and contact the lower surfaces (i.e., the surfaces that contact the thin plate 10) of the impregnated members 25 of the upper surface applying unit 22.

The impregnated member bearing rollers 104 have rotational axes that are orientated in the conveying direction of the thin plate 10 and are provided so as to be capable of freely rotating.

The impregnated member bearing rollers 104 hold the lower surfaces of the impregnated members 25 when the upper surface applying unit 22 has moved in the width direction of the thin plate 10 so that the impregnated members 25 protrude beyond end portions in the width direction of the thin plate 10. This means that even when the impregnated members 25 protrude beyond the end portions in the width direction of the thin plate 10, it is possible to prevent the impregnated members 25 from falling out of the holder portion 26 or from slipping downward without completely falling out.

Machining Oil Spreading Portion

An upper surface machining oil spreading portion 100 that contacts the upper surface of the thin plate 10 in order to make the pattern of the machining oil that has been applied by the upper surface applying unit 22 uniform is provided downstream in the conveying direction of the thin plate 10 of the position where the upper surface applying unit 22 is disposed.

Figure 7:
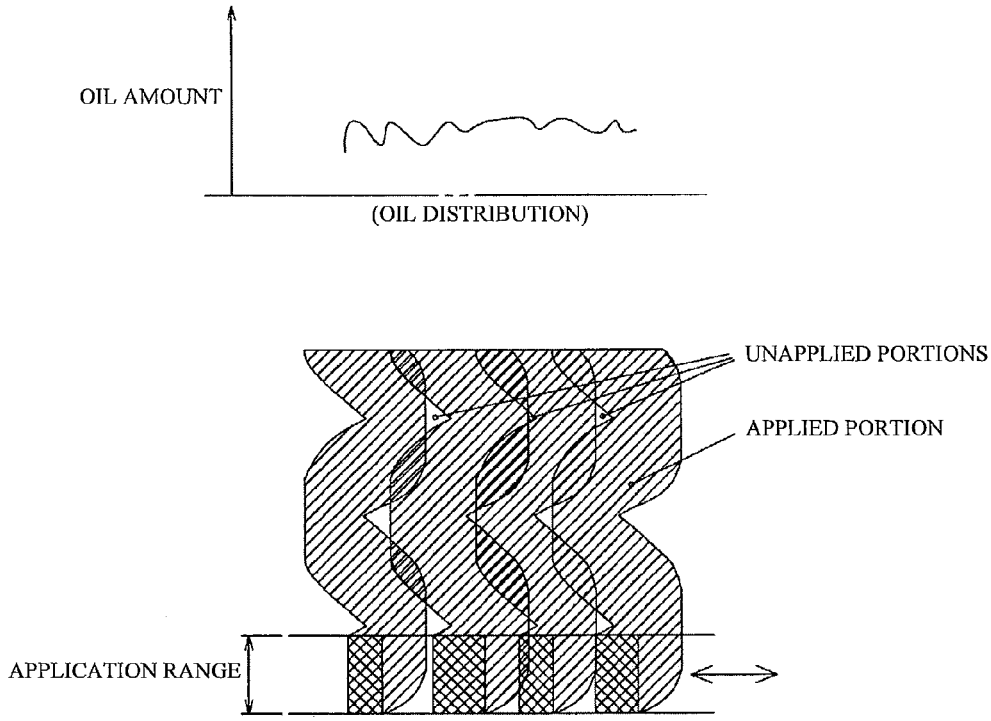
FIG. 7 is a diagram useful in explaining a case where unapplied parts are produced.
Figure 8:
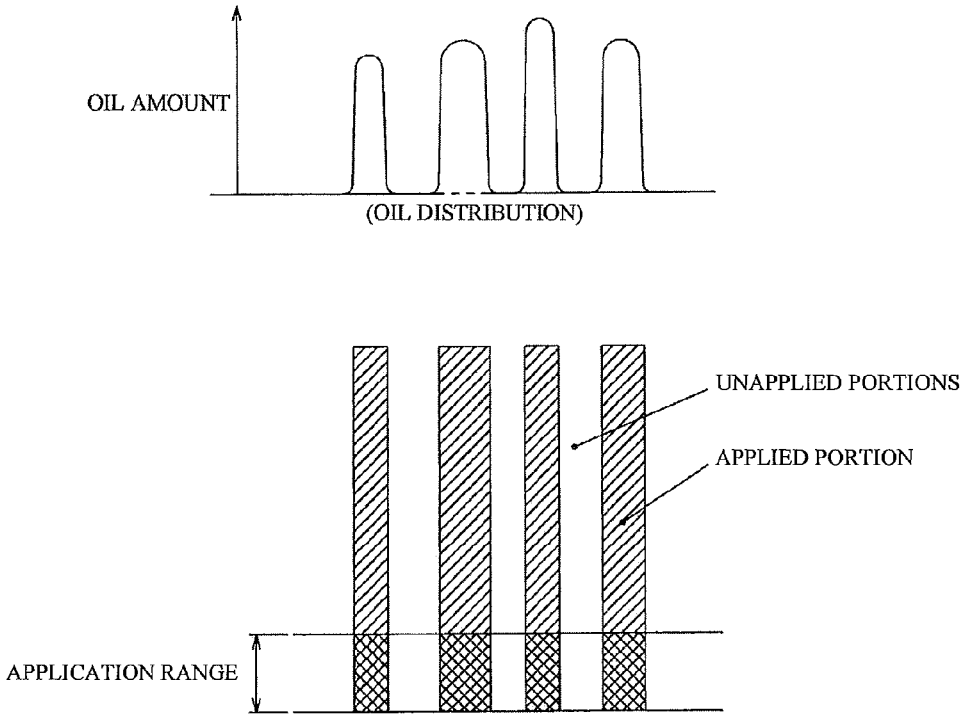
FIG.8 PRIOR ART
FIG. 8 is a diagram useful in explaining a conventional case where unapplied parts are produced.

This is because, as depicted in FIG. 7, in a case where the upper surface applying unit 22 has been unevenly impregnated, there is the possibility that unapplied portions (non-oiled portions) would be produced on the thin plate 10 if the upper surface applying unit 22 were simply moved reciprocally in the width direction of the thin plate 10.

In some cases, this might not be problematic if the speed of the reciprocal movement of the upper surface applying unit 22 were set high relative to the conveying speed of the thin plate 10. However, by simply providing the upper surface machining oil spreading portion 100, it becomes possible to reliably eradicate unapplied portions (non-oiled portions) even when the speed of the reciprocal movement of the upper surface applying unit 22 is not increased.

The upper surface machining oil spreading portion 100 is rectangular in shape with the length thereof in the width direction of the thin plate 10 and is fixed at a predetermined position so as to not move.

In the same way as the impregnated members provided in the upper surface applying unit 22, as the upper surface machining oil spreading portion 100, it is possible to use any material that is capable of being impregnated with machining oil and has sufficient durability when placed in contact with the surface of the thin plate 10. In the present embodiment, felt, which is one type of nonwoven fabric, is used.

In addition, a lower surface machining oil spreading portion 102 that contacts the lower surface of the thin plate 10 in order to make the pattern of the machining oil that has been applied by the lower surface applying unit 24 uniform is provided downstream in the conveying direction of the thin plate 10 of the position where the lower surface applying unit 24 is disposed. The lower surface machining oil spreading portion 102 is also capable of reliably eradicating unapplied portions that occur as depicted in FIG. 7 described above when the lower surface applying unit 24 has been unevenly impregnated.

The lower surface machining oil spreading portion 102 is rectangular in shape with the length thereof in the width direction of the thin plate 10 and is fixed at a predetermined position so as to not move.

In the same way as the impregnated members provided in the lower surface applying unit 24, as the lower surface machining oil spreading portion 102, it is possible to use any material that is capable of being impregnated with machining oil and has sufficient durability when placed in contact with the surface of the thin plate 10. In the present embodiment, felt, which is one type of nonwoven fabric, is used.

In this way, after the machining oil has been applied by the upper surface applying unit 22 and the lower surface applying unit 24, the upper surface machining oil spreading portion 100 and the lower surface machining oil spreading portion 102 operate so that machining oil at positions where oil has already been applied is absorbed by the felt and such machining oil that has been absorbed by the felt is applied to the unapplied portions.

This results in machining oil being uniformly applied to the surfaces of the thin plate 10.

OTHER EMBODIMENTS

The means for operating the upper surface applying unit 22 and the lower surface applying unit 24 so that the movement thereof in a direction perpendicular to the conveying direction of the thin plate 10 is always in respectively opposite directions is realized in the embodiment described above using a single motor and two eccentric cams whose respective phases differ by 180°.

However, the present invention is not limited to such construction and as one example it is also possible to provide an upper surface air cylinder for moving the upper surface applying unit 22 reciprocally in the width direction of the thin plate 10, to separately provide a lower surface air cylinder for moving the lower surface applying unit 24 reciprocally in the width direction of the thin plate 10, and to carry out control so that the upper surface air cylinder and the lower surface air cylinder operate alternately.

The machining oil applying apparatus according to the present invention is also not limited to being used to manufacture heat exchanger fins.

Although various preferred embodiments of the present invention have been described above, it should be obvious that the present invention is not limited to such embodiments and can be subjected to a variety of modifications within a range that does not depart from the spirit of the invention.

What is claimed is:

1. A machining oil applying apparatus that applies machining oil onto a thin plate made of metal that is to be supplied to a press apparatus and is being conveyed toward the press apparatus, the machining oil applying apparatus comprising:

an upper surface applying unit that is impregnated with the machining oil, contacts an upper surface of the thin plate and applies the machining oil onto the upper surface of the thin plate;

a lower surface applying unit that is impregnated with the machining oil, contacts a lower surface of the thin plate and applies the machining oil onto the lower surface of the thin plate; and an applying unit moving portion that causes the upper surface applying unit and the lower surface applying unit to move reciprocally in a direction that is perpendicular to a conveying direction of the thin plate, wherein the applying unit moving portion comprises:

a rotational shaft being extended in the vertical direction:

a motor for rotating the rotational shaft; and two eccentric cams that are attached onto the rotational shaft, the rotational shaft passes through and is fixed to the eccentric cams at positions that are predetermined distances from centers of circles respectively, the fixed positions of the two eccentric cams, where the rotational shaft is fixed, are positioned with point symmetry with respect to the rotational shaft when viewed from above, the upper eccentric cam of the two eccentric cams is disposed in a cam hole of an upper cam guide place, cam guide plate, the lower eccentric cam thereof is disposed in a cam hole of a lower cam guide plate, one end of the upper cam guide plate is fixed to an upper plate, on which the upper surface applying unit is provided, one end of the lower cam guide plate is fixed to a lower plate, on which the lower surface applying unit is provided, and since the center positions of the two eccentric cams fixed to the rotational shaft are positioned with point symmetry with respect to the rotational shaft, the movement of the upper cam guide plate and the lower cam guide plate caused by the rotation of the rotational shaft, in a direction perpendicular to the conveying direction of the thin plate, is always in opposite directions, thereby the upper surface applying unit and the lower surface applying unit always reciprocate with opposite phase.

2. A machining oil applying apparatus that applies machining oil onto a thin plate made of metal that is to be supplied to a press apparatus and is being conveyed toward the press apparatus, the machining oil applying apparatus comprising:

an upper surface applying unit that is impregnated with the machining oil, contacts an upper surface of the thin plate and applies the machining oil onto the upper surface of the thin plate;

a lower surface applying unit that is impregnated with the machining oil, contacts a lower surface of the thin plate and applies the machining oil onto the lower surface of the thin plate; and an applying unit moving portion that causes the upper surface applying unit and the lower surface applying unit to move reciprocally in a direction that is perpendicular to a conveying direction of the thin plate, wherein the applying unit moving portion requires the upper surface applying unit to move reciprocally in a direction that is opposite to a moving direction of the lower surface applying unit, and wherein the upper surface applying unit includes:

an impregnated member that is impregnated with the machining oil;

a holding member that holds circumferential side surfaces of the impregnated member; and pressure applying means for applying pressure to an opposite surface of the impregnated member to a contact surface of the impregnated member that contacts the thin plate so as to uniformly press the contact surface onto the thin plate, said pressure applying means including a pressure applying pin that applies pressure to the opposite surface of the impregnated member to the contact surface;

an air accumulating chamber in which an upper end surface of the pressure applying pin is disposed;

air supplying means for supplying air into the air accumulating chamber; and a plate that covers the opposite surface of the impregnated member to the contact surface and is capable of movement in an up-down direction, wherein the pressure applying pin applies pressure to the plate due to air supplied into the air accumulating chamber.

3. A machining oil applying apparatus that applies machining oil onto a thin plate made of metal that is to be supplied to a press apparatus and is being conveyed toward the press apparatus, the machining oil applying apparatus comprising:

an upper surface applying unit that is impregnated with the machining oil, contacts an upper surface of the thin plate and applies the machining oil onto the upper surface of the thin plate;

a lower surface applying unit that is impregnated with the machining oil, contacts a lower surface of the thin plate and applies the machining oil onto the lower surface of the thin plate; and an applying unit moving portion that causes the upper surface applying unit and the lower surface applying unit to move reciprocally in a direction that is perpendicular to a conveying direction of the thin plate, wherein the applying unit moving portion requires the upper surface applying unit to move reciprocally in a direction that is opposite to a moving direction of the lower surface applying unit, an upper surface machining oil spreading portion that contacts the upper surface of the thin plate to make a pattern of the machining oil applied by the upper surface applying unit uniform, the upper surface machining oil spreading portion being provided downstream in the conveying direction of the thin plate of a position where the upper surface applying unit is disposed, and a lower surface machining oil spreading portion that contacts the lower surface of the thin plate to make a pattern of the machining oil applied by the lower surface applying unit uniform, the lower surface machining oil spreading portion being provided downstream in the conveying direction of the thin plate of a position where the lower surface applying unit is disposed, wherein the upper surface applying unit includes:

an impregnated member that is impregnated with the machining oil;

a holding member that holds circumferential side surfaces of the impregnated member; and pressure applying means for applying pressure to an opposite surface of the impregnated member to a contact surface of the impregnated member that contacts the thin plate so as to uniformly press the contact surface onto the thin plate, said pressure applying means including a pressure applying pin that applies pressure to the opposite surface of the impregnated member to the contact surface;

an air accumulating chamber in which an upper end surface of the pressure applying pin is disposed;

air supplying means for supplying air into the air accumulating chamber; and a plate that covers the opposite surface of the impregnated member to the contact surface and is capable of movement in an up-down direction, wherein the pressure applying pin applies pressure to the plate due to air supplied into the air accumulating chamber.

4. A machining oil applying apparatus that applies machining oil onto a thin plate made of metal that is to be supplied to a press apparatus and is being conveyed toward the press apparatus, the machining oil applying apparatus comprising:

an upper surface applying unit that is impregnated with the machining oil, contacts an upper surface of the thin plate and applies the machining oil onto the upper surface of the thin plate;

a lower surface applying unit that is impregnated with the machining oil, contacts a lower surface of the thin plate and applies the machining oil onto the lower surface of the thin plate; and an applying unit moving portion that causes the upper surface applying unit and the lower surface applying unit to move reciprocally in a direction that is perpendicular to a conveying direction of the thin plate, wherein the applying unit moving portion requires the upper surface applying unit to move reciprocally in a direction that is opposite to a moving direction of the lower surface applying unit, and wherein the upper surface applying unit and/or the lower surface applying unit includes:

a plurality of impregnated members that are impregnated with the machining oil and are aligned in a direction that is perpendicular to the conveying direction of the thin plate; and partitions that are provided between the respective impregnated members and prevent the machining oil from passing between the impregnated members, wherein the upper surface applying unit includes:

an impregnated member that is impregnated with the machining oil;

a holding member that holds circumferential side surfaces of the impregnated member; and pressure applying means for applying pressure to an opposite surface of the impregnated member to a contact surface of the impregnated member that contacts the thin plate so as to uniformly press the contact surface onto the thin plate, wherein the pressure applying means includes:

a pressure applying pin that applies pressure to the opposite surface of the impregnated member to the contact surface;

an air accumulating chamber in which an upper end surface of the pressure applying pin is disposed;

air supplying means for supplying air into the air accumulating chamber; and a plate that covers the opposite surface of the impregnated member to the contact surface and is capable of movement in an up-down direction, and wherein the pressure applying pin applies pressure to the plate due to air supplied into the air accumulating chamber.

* * * * *